United States Patent [19]

Beirute et al.

[11] Patent Number: 4,819,726

[45] Date of Patent: Apr. 11, 1989

[54] METHOD FOR INDICATING THE POSITION OF A CEMENT WIPER PLUG PRIOR TO ITS BOTTOMHOLE ARRIVAL

[75] Inventors: Robert M. Beirute, Broken Arrow; Robert C. Smith, Inola, both of Okla.

[73] Assignee: Amoco Corporation, Chicago, Ill.

[21] Appl. No.: 112,024

[22] Filed: Oct. 20, 1987

Related U.S. Application Data

[63] Continuation of Ser. No. 743,183, Jun. 10, 1985, abandoned.

[51] Int. Cl.[4] ..... E21B 33/16

[52] U.S. Cl. ..... 166/291; 166/156

[58] Field of Search ..... 166/285, 291, 253, 153, 166/156, 290, 177, 170, 154

[56] References Cited

U.S. PATENT DOCUMENTS

| | | | |
|---|---|---|---|
| 1,851,289 | 3/1932 | Owen | 166/153 X |
| 2,438,992 | 4/1948 | Childers | 166/154 |
| 3,223,170 | 12/1965 | Mott | 166/153 X |
| 3,638,730 | 2/1972 | Smith | 166/291 |
| 3,791,448 | 2/1974 | Schuh | 166/291 |
| 3,910,349 | 10/1975 | Brown et al. | 166/153 |
| 4,379,838 | 4/1983 | Ogden et al. | 166/153 |
| 4,510,994 | 4/1985 | Pringle | 166/156 |

FOREIGN PATENT DOCUMENTS

| | | | |
|---|---|---|---|
| 186919 | 10/1965 | U.S.S.R. | 166/156 |
| 0652313 | 3/1979 | U.S.S.R. | 166/156 |

OTHER PUBLICATIONS

"The Phenomenon of Free Fall During Primary Cementing", SPE Paper 13045, R. M. Beirute, 1984.

*Primary Examiner*—Stephen J. Novosad
*Assistant Examiner*—David J. Bagnell
*Attorney, Agent, or Firm*—Scott H. Brown; Fred E. Hook

[57] ABSTRACT

A method and apparatus for indicating the position of a cement wiper plug in a wellbore during liner or casing cementing operations. The arrival of the cement wiper plug at a shearable, temporary restriction means in a pipe string is sensed by an increase in pipe string pressure at the surface. Using the knowledge of the location of this shearable, temporary restriction means, a determination of whether or not it is desirable to displace the cement wiper plug to a landing assembly at the bottom of the pipe string can be made. A predetermined amount of displacing fluid, sufficient to either completely or partially displace the cement wiper plug to the landing assembly, can then be introduced into the pipe string. The apparatus includes a section of pipe string with an interior shearable, temporary restricting means to restrict the motion of the cement wiper plug through the section of pipe string, and a casing string wiper plug, for those casing string cementing operations where at least one casing string wiper plug may be required, designed to pass the interior shearable, temporary restricting means without shearing it from the interior of the section of pipe string.

5 Claims, 2 Drawing Sheets

METHOD FOR INDICATING THE POSITION OF A CEMENT WIPER PLUG PRIOR TO ITS BOTTOMHOLE ARRIVAL

This is a continuation of copending application Ser. No. 743,183 filed on June 10, 1985 now abandoned.

BACKGROUND OF THE INVENTION

This invention is related to the determination of the position of a cement wiper plug in a pipe string run in the wellbore during the cementing of this pipe string in a wellbore, and is more particularly directed to the indication of the arrival of a cement wiper plug at a predetermined position in this pipe string during these cementing operations.

In the drilling of wellbores for the production of hydrocarbons from subsurface formations, cement is pumped into the annulus between the pipe string run in the wellbore and the wall of the wellbore to both secure the pipe string in the wellbore, and to prevent communication between different subsurface formations from occurring in the annulus between the pipe string and the wall of the wellbore. In placing this cement in the annulus, it is common practice to pump a volume of cement slurry sufficient to fill this annulus down the pipe string and then to displace this volume of cement slurry by pumping a displacing fluid, such as drilling mud behind the cement slurry. Generally, a cement wiper plug is used to separate the cement slurry from the displacing fluid, and to wipe the interior surface of the pipe string clean of cement. This cement wiper plug, by seating in a landing assembly, either a float collar or landing collar, located near the bottom of the pipe string also serves to seal the annulus from the pipe string and prevent any pumping of displacing fluid from the pipe string into the annulus after the cement slurry has been placed in the annulus. In this way, the possibility of there being either displacing fluid instead of cement slurry or a cement slurry contaminated with displacing fluid in the lower portion of the annulus between the pipe string and the wall of the wellbore is reduced. Further, the seating of the cement wiper plug in the landing assembly causes an increase in the pipe string pressure which provides an indication that all of the cement has been displaced from the pipe string into the annulus between the pipe string and the wall of the wellbore, thus indicating that the cementing operation has been completed. Any backflow of cement from the annulus between the pipe string and the wall of the wellbore to the pipe string can be prevented by the utilization of either a float collar and/or a pipe string cement shoe, containing one way flow check valves. This pipe string run in the wellbore can be either a liner run from a hanger within a larger pipe string to the lower bottom hole end of the wellbore or casing string run from the surface end of the wellbore to the lower bottom hole end on the wellbore.

In a liner cementing operation, the volume of cement slurry to be used to fill the annulus between the wall of the wellbore and the liner with cement, is introduced into the liner through a smaller diameter drill string. A drill string wiper plug, released from the surface, is used to separate the cement slurry slug from the displacing fluid, and to wipe the interior of the drill string clean of cement. This drills string wiper plug is displaced through the drill string with a displacing fluid pumped into the drills string from the surface. In the case of a liner cementing operation, a larger second plug is held in place at the lower end of the drill string, but inside the liner by a latching mechanism. The cement is displaced through a center bore in this second plug into the liner and from there into the annulus between the liner and the wellbore. The drill string wiper plug seats in this second plug in a sealing relationship to form a single cement wiper plug, and the latching mechanism is released, causing the cement wiper plug to be displaced behind the cement slurry slug in the liner, thus displacing this cement through the liner, separating the displacing fluid from the cement slurry, and wiping the interior of the liner clean of cement. This cement wiper plug seats in a landing assembly located near the bottom of the liner so as to prevent any pumping of displacing fluid from the liner to the annulus between the liner and the wall of the wellbore. In this way, the displacing fluid in the liner is prevented from displacing or commingling with the cement in the annulus. Further, an indication of the end of the liner cementing operation is provided by the increase in the drill string pressure when the cement wiper plug seats in the landing assembly.

In these liner cementing operations, it is advantageous to know the location of the cement wiper plug in the liner relative to the volume of displacing fluid that has been pumped downhole, as a form of a check point in the liner cementing operation. The provision of check points is important since the displacement of the cement wiper plug to the landing assembly is critical. In the case where displacing fluid has gotten past the cement wiper plug to the cement side of the cement wiper plug, a displacement of the cement wiper plug to the landing assembly would result in the displacing fluid either replacing or commingling with and contaminating the cement slurry around the bottom downhole end of the liner. Thus, in such a case, it is important to provide a check of cement wiper plug location for a given volume of displacing fluid pumped to determine if any displacing fluid has gotten past the cement wiper plug to the cement side of the cement wiper plug and also to provide an indication of the additional volume of displacing fluid that must be pumped to fully seat the cement wiper plug in the landing assembly.

In current practice, an increase in drill string pressure is sometimes observed, when the drill string wiper plug engages the liner wiper plug prior to the release of the latching mechanism holding the liner wiper plug in place. The increase in drill string pressure is used to provide an indication of the location of the cement wiper plug and from this, both a check of wiper plug location for a given volume of displacing fluid pumped and a cement wiper plug location determination from which the volume of displacing fluid required to displace the cement wiper plug to the landing assembly are provided. However, it has been observed that in cementing deep, long liners, frequently the cement slurry is on a free-fall down the drills string and liner, creating a vacuum in the drill string near the surface behind the free-falling column of fluids, which causes the liner wiper plug latching mechanism to release when the drill string wiper plug contacts it, without an observed increase in drills string pressure. This free-fall phenomena has been described by R. M. Beirute in SPE Paper 13045, "The Phenomenon of Free Fall During Primary Cementing." Because of this lack of an observed increase in drill string pressure, there is no indication of the position of the cement wiper plug from which both a check of wiper plug location for a given volume of displacing fluid pumped and a determination of the volume of displacing fluid sufficient to seat the cement wiper plug in the landing assembly can be obtained.

In the case of casing string cementing operations, the cement slurry is introduced into the casing string and a cement wiper plug is used to separate the cement slurry from the displacing fluid used to displace the cement slurry slug down the casing string and up the annulus between the casing string and the wall of the wellbore, and to wipe the interior of the casing string clean of cement. It is advantageous to know the volume of fluid required to properly seat the cement wiper plug in a landing assembly located near the bottom of the casing string, so as to prevent any pumping of displacing fluid from the casing string to the annulus. In this way the above-mentioned problems of the displacing fluid replacing or commingling with the cement in the annulus between the wall of the wellbore and the casing string are avoided. Further, this provides an indication of the end of the casing string cementing operation through the increase in the casing string pressure.

BRIEF DESCRIPTION OF THE INVENTION

In the present invention at least one means is shearably connected to the interior wall of a pipe string in a wellbore for temporarily restricting the movement of a cement wiper plug through the pipe string located a known distance from a landing assembly attached near the lower end of the pipe string. This shearable means is designed to be sheared when a predetermined pressure is applied to the cement wiper plug by way of the displacing fluid, and is located at a position in the pipe string where the cement slurry is not expected to be on free fall and is expected to be displaced by applying pressure to the cement wiper plug. The resulting pressure increase in the pipe string at the surface caused by the cement wiper plug contacting the shearable means provides an indication that the cement wiper plug has reached the shearable means and has been temporarily retained by it. This provides a clear signal of the location of the cement wiper plug. From this, both a check of the cement wiper plug location for a given volume of displacing fluid pumped and a determination of the volume of the displacing fluid required to displace the cement wiper plug from the shearable means to the landing assembly attached near the lower end of the pipe string at the bottom of the wellbore can be obtained.

DETAILED DESCRIPTION

Figure 1:
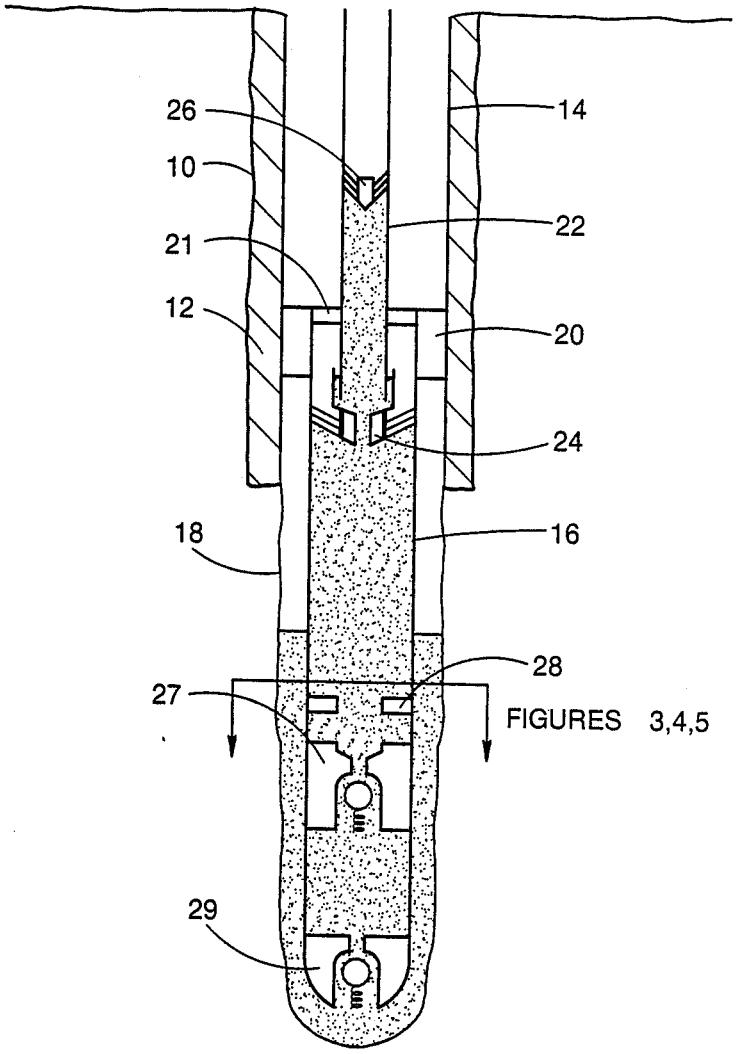
FIG. 1 is a schematic side view of a wellbore during a liner cementing operation with the method and apparatus of the present invention utilized.

The apparatus of the invention is shown in FIG. 1 in connection with a liner cementing system for use in cementing a liner in place in a wellbore. Uphole, steel casing 14 is cemented into place in a wellbore 10 by cement 12. The illustrated apparatus is used in cementing a liner 16 into a newly drilled portion of the wellbore 18. The liner 16 is attached to the casing 14 by a liner hanger 20 and extends downward into the newly drilled portion of the wellbore 18.

The apparatus of the present invention is illustrated in FIG. 1 as might be installed in a liner. A sufficient volume of cement slurry is pumped into the wellbore through drill string 22 to cement the liner 16 in place by filling the annulus between the wall of the newly drilled portion of the wellbore 18 and the liner 16 with cement. At the bottom of the drill string 22 and shearably fastened to it is a liner wiper plug 24. A seal mandrel 21 is utilized to prevent the cement slurry from flowing up the annulus between the drill string 22 and the liner 16 and into the annulus between the drill string 22 and the casing 14.

The liner wiper plug 24 contains a central bore therethrough for passing the cement slurry from the drill string 22 into the liner 16. When the desired amount of cement has been pumped into the drill string, a drill string wiper plug 26 is introduced into the drill string 22. This drill string wiper plug serves to prevent the displacing fluid which will be pumped into the drill string 22 to force the cement slurry slug downhole, from mixing with the cement slurry and also serves to wipe the interior surface of the drill string 22 clean of cement.

The displacing fluid is pumped into the drill string 22 above the drill string wiper plug 26 to pump the drill string wiper plug 26 downwardly through the drill string 22 and into a seat in the liner wiper plug 24. By way of this seat in the liner wiper plug 24, the drill string wiper plug 26 and liner wiper plug 24 form a single cement wiper plug which will displace the cement slurry down the liner 16 and wipe the interior surface of the liner 16 clean of cement. As pressure is applied to the top of the cement wiper plug formed by the seating of the drill string wiper plug 26 in the liner wiper plug 24, the shearable fastening means holding the liner wiper plug 24 in place shears, thus releasing the cement wiper plug. This cement wiper plug is then displaced down the liner 16 displacing the cement below the cement wiper plug out the bottom of the liner 16, through one way check valves in both float collar 27 and liner cement show 29, and up the annulus between the liner 26 and the wall of the wellbore 18.

Figure 2:
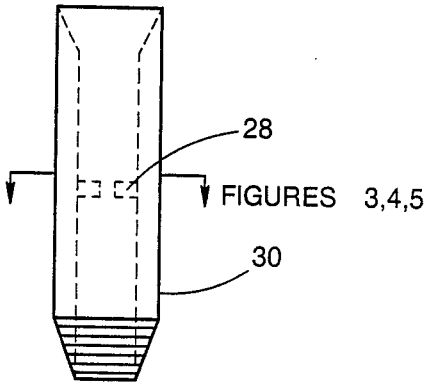
FIG. 2 is a schematic side view of a section of pipe string useful in the present invention.
Figure 3:
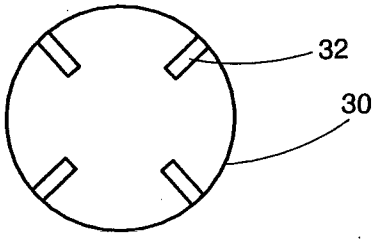
FIG. 3 is a cross-sectional view across the pipe string showing internal projections shearably affixed to the interior wall of the pipe string useful in the present invention.
Figure 4:
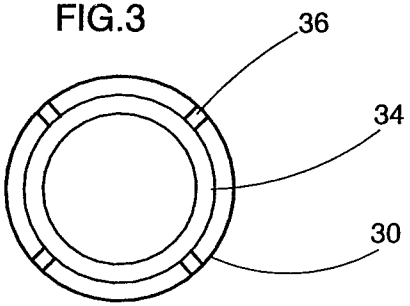
FIG. 4 is a cross-sectional view across the pipe string showing internal projections shearably affixed to the interior wall of the pipe string to which a circumferentially continuous ring is attached useful in the present invention.
Figure 5:
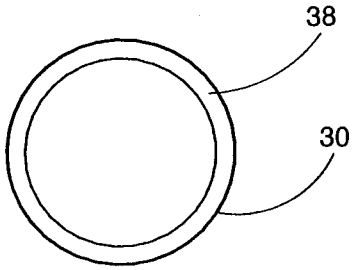
FIG. 5 is a cross-sectional view across the pipe string showing a circumferentially continuous ring shearably connected with the internal wall of the pipe string useful in the present invention.

The apparatus of the present invention comprises at least one means 28 for temporarily restricting the motion of the cement wiper plug through the liner 16 shearably connected to the interior of the liner 16 in that region of the liner 16, where the cement slurry is not expected to be on free fall and is expected to be displaced by applying pressure to the cement wiper plug. One embodiment of the present invention is shown in FIG. 2, wherein the shearable, temporary restricting means 28 is contained in a section of liner 30, which is inserted into the liner 16 near the lower bottomhole end of the liner 16. The shearable, temporary restricting means 28 can consist of any suitable shearable means, such as at least one projection 32 affixed to the interior surface of the liner section 30 by screws, bolts or welds, as shown in FIG. 3. The shearable, temporary restricting means 28 can also consist of a concentric ring 34 attached to the interior wall of the liner section 30 by at least one shearable projection 36, as is shown in FIG. 4, or a concentric ring 38 bonded directly to the interior wall of the liner section 30, as is shown in FIG. 5.

Figure 8:
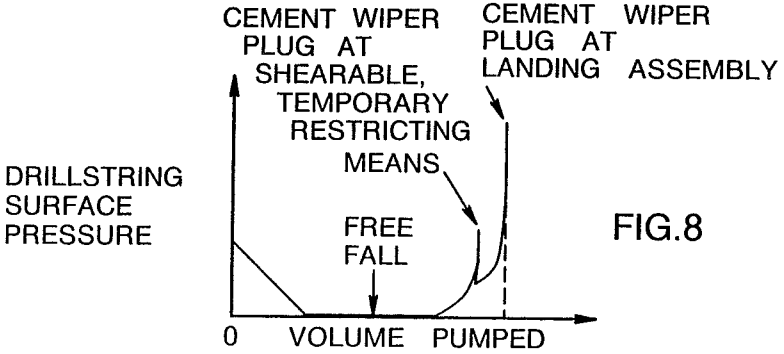
FIG. 8 is a graph showing a representation of the surface pressure increase in the pipe string experienced when the present invention is utilized.

FIG. 8 shows a representation of the relationship of surface pressure in the drill string 22 versus volume of displacing fluid pumped, for the case of a deep, long liner cementing operation. This representation is a result of monitoring at the surface the pumping pressure of the displacement liquid. In the example illustrated in FIG. 8, the pressure initially decreases as the cement in the drills string 22 and liner 16 is on free-fall. When the cement wiper plug reaches the shearable, temporary restricting means 28 of the present invention, an increase in the pressure in the drill string will be observed. The shearable, temporary restricting means 28 is designed and sized so as to contact the body of the cement wiper plug, thereby restricting the motion of the cement wiper plug until the shearable, temporary restricting means 28 is sheared from the interior wall of the liner. Through a knowledge of the location of the shearable, temporary restricting means 28, the volume of displacing fluid required to displace the cement wiper plug to the shearable, temporary restricting means 28 can be determined, which provides a check of cement wiper plug location relative to the volume of displacing fluid pumped. Further, the volume of displacing fluid required to displace the cement wiper plug to a landing assembly, in this case float collar 27, attached to the lower end of the liner 16 at the bottom of the wellbore can be accurately determined. From those two pieces of information, a determination of whether or not it is proper to displace the cement wiper plug all of the way through the liner to the float collar 27 and the volume of displacing fluid required to accomplish this complete displacement of the cement wiper plug to the float collar 27 can be made. This determination allows one to prevent the expulsion of displacing fluid past the float collar 27 and the liner cement shoe 29 and either a displacement of the cement slurry or a commingling of the displacing fluid with the cement slurry and thus, a contamination of the cement slurry in the annulus.

The apparatus of the present invention and the process for use of this apparatus can also be utilized in casing string cementing operations. The current practice in casing string cementing operations is to use two plugs to separate the cement slurry from fluids in the wellbore and to wipe the casing string clean of mud; a bottom plug, a casing string wiper plug, is introduced into the casing string prior to the cement slurry to separate the cement slurry from fluids previously in the wellbore and to wipe the casing string clean of mud; a last plug, a cement wiper plug, is introduced into the casing string after the cement slurry to separate the cement slurry from the displacing fluid and to wipe the interior of the casing string clean of cement. In the event that a spacer fluid is utilized between the fluids in the wellbore and the cement slurry, to ensure that there is no commingling of the fluids previously in the wellbore with the cement slurry, two or more casing string wiper plugs may be utilized. In order to utilize the apparatus of the present invention and the process for use of this apparatus, the bottom plug, the casing string wiper plug, must be omitted, or be of such a type that it is able to pass through the means for temporarily restricting the motion of the cement wiper plug through the casing string shearably connected to the interior wall of the casing string without shearing this shearable, temporary restricting means from the interior wall of the casing string, or be of such a type that it opens the shearable, temporary restricting means after it has passed the location of this shearable, temporary restricting means. Then, the cement slurry is introduced into the casing string, followed by the cement wiper plug. THe temporary restriction of this cement wiper plug by the shearable, temporary restricting means provides an indication at the surface, through an increase in the casing string pressure, of the cement wiper plug engaging this shearable, temporary restricting means. Through a knowledge of the location of this shearable, temporary restricting means, both a check of the cement wiper plug location relative to the volume of displacing fluid pumped and a determination of the volume of displacing fluid required to displace the cement wiper plug to a landing assembly attached to the lower end of the casing string at the bottom of the wellbore can be determined. This allows a determination of whether or not it is proper to displace the cement wiper plug fully through the casing string to the landing assembly and a determination of the volume of displacing fluid required to completely displace the cement wiper plug to the landing assembly to be made. This determination prevents expulsion of displacing fluid past the landing assembly and either a displacement of the cement slurry or a commingling of the displacing fluid with the cement slurry in the annulus.

Figure 6:
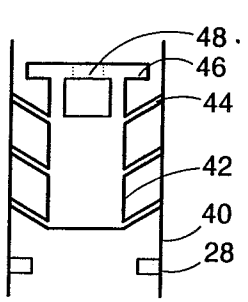
FIG. 6 is a schematic side view of a bottom casing wiper plug, useful in the present invention, during a casing cementing operation, with the apparatus of the present invention installed in the casing string.
Figure 7:
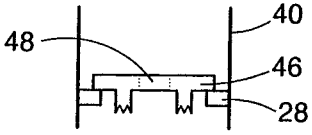
FIG. 7 is a schematic side view of a casing string after the bottom casing wiper plug has passed the apparatus of the present invention installed in a casing string, during a casing cementing operation.

One embodiment of the casing string wiper plug referred to above is shown in FIG. 6. The casing string wiper plug 42 is run ahead of the cement slurry in a casing string 40 containing means for temporarily restricting the motion of the cement wiper plug through the casing string shearably connected to the interior of the casing string 40. The shearable, temporary restricting means 28 is such that the rubber ribs 44 of the casing string wiper plug 42 ride over the shearable, temporary restricting means 28 without shearing the shearable, temporary restricting means 28 from the interior of the casing string 42. However, ring 46, which is shearably connected to the casing string wiper plug 42, does not ride over the shearable, temporary restricting means 28, but rather is sheared from the casing string wiper plug 42, and is left as shown in FIG. 7, sitting on top of the shearable, temporary restricting means 28. The cement slurry will then pass through central bore 48 in ring 46, into that portion of the casing string 40 below the shearable, temporary restricting means 28. The cement wiper plug, because it will not pass through central bore 48, will be temporarily retained by ring 46 and shearable, temporary restricting means 28, until the pressure applied to the top of the cement wiper plug is sufficient to shear the shearable, temporary restricting means 28 from the interior of the casing string.

In both the case of liner and casing string cementing operations, it may be desirable to utilize several shearable, temporary restricting means of the present invention at different locations in the pipe string to provide several points at which a check of cement wiper plug location relative to the volume of displacing fluid pumped and a determination of the volume of displacing fluid required to displace the cement wiper plug to a landing assembly attached to the lower end of the pipe string can be determined.

While the above invention has been described with respect to several embodiments, various modifications can be made thereto without departing from the spirit or scope of the invention.

What is claimed is:

1. A method for cementing a pipe within a wellbore, comprising:

(a) introducing a first plug within the pipe;
(b) introducing a cement slurry within the pipe;
(c) introducing a second plug within the pipe;
(d) introducing a displacement liquid within the pipe to displace the cement through an opening in a lower portion of the pipe and into the wellbore;
(e) displacing the first plug past, without shearing, a restricting device affixed within a lower portion of the pipe;
(f) monitoring at the surface a pumping pressure of the displacement liquid; and
(g) determining the volume of liquid required to seat the second plug in a landing assembly located within the pipe after the monitored occurrence of a rapid increase and decrease of the pumping pressure caused by the second plug engaging and shearing the restrictive device.

2. The method of claim 1 wherein the restriction device is located within the pipe at a point below which free-fall of the cement slurry has ceased.

3. A method for cementing a liner comprising:

(a) introducing a cement slurry into the liner through a drill string having a first plug shearably attached at the lower end thereto, the first plug having a central bore therethrough for passing the cement slurry from the drill string into the liner;
(b) introducing a second plug within the drill string, the second plug being of a diameter sufficient to sealably engage with the central bore of the first plug;
(c) introducing sufficient displacement liquid into the drill sting to seat the second plug into the central bore of the first plug thereby forming a single cement wiper plug unit;
(d) continuing to introduce sufficient displacement liquid to shearably move the cement wiper plug unit within the drill string;
(e) continuing to introduce sufficient displacement fluid to cause the cement wiper plug unit to engage and shear a restriction device located in the liner, the cement wiper plug unit having sufficient cross sectional area to cause a distinct increase and decrease in surface pumping pressure of the displacement liquid;
(f) monitoring and detecting at the surface the distinct increase and decrease in the surface pumping pressure of the displacement liquid; and
(h) determining whether displacement liquid has bypassed the cement wiper plug unit, and if not, introducing sufficient displacement liquid into the liner to seat the cement wiper plug unit in a landing assembly located within the liner.

4. A method of claim 3 wherein the restriction device comprises at least one projection affixed to the interior surface of the liner.

5. The method of claim 3 wherein the restriction device is located within the liner at a point below which free-fall of the cement slurry has ceased.

* * * * *